US011220806B2

(12) United States Patent
Lombardo et al.

(10) Patent No.: US 11,220,806 B2
(45) Date of Patent: Jan. 11, 2022

(54) CORNER WEAR PLATE ASSEMBLY

(71) Applicants: Pasquale Lombardo, Phoenix, AZ (US); Gaetano Lombardo, Phoenix, AZ (US)

(72) Inventors: Pasquale Lombardo, Phoenix, AZ (US); Gaetano Lombardo, Phoenix, AZ (US)

( * ) Notice: Subject to any disclaimer, the term of this patent is extended or adjusted under 35 U.S.C. 154(b) by 0 days.

(21) Appl. No.: 17/194,237

(22) Filed: Mar. 6, 2021

(65) Prior Publication Data

US 2021/0277633 A1 Sep. 9, 2021

Related U.S. Application Data

(60) Provisional application No. 62/987,291, filed on Mar. 9, 2020.

(51) Int. Cl.
*E02F 9/28* (2006.01)

(52) U.S. Cl.
CPC ..... *E02F 9/2883* (2013.01)

(58) Field of Classification Search
CPC ..... E02F 3/8152; E02F 3/8155; E02F 3/40; B23K 31/025
See application file for complete search history.

(56) References Cited

U.S. PATENT DOCUMENTS 4,086,712 A 5/1978 McReynolds
4,128,132 A 12/1978 Moen et al.
4,129,952 A 12/1978 Olson
4,315,375 A 2/1982 Shinn
4,716,666 A 1/1988 Potter
RE33,454 E 11/1990 Potter
5,005,304 A 4/1991 Briscoe et al.
5,055,336 A * 10/1991 Davis ..... B65G 11/166 428/137
5,056,243 A 10/1991 Sprunger et al.
5,088,214 A 2/1992 Jones
5,129,168 A 7/1992 Hedley
5,203,513 A 4/1993 Keller et al.
5,241,765 A 9/1993 Jones et al.
5,564,508 A * 10/1996 Renski ..... E02F 9/2883 172/772
5,634,285 A 6/1997 Renski
5,666,748 A 9/1997 Emrich et al.
5,913,605 A * 6/1999 Jusselin ..... E02F 9/2883 37/451

(Continued)

*Primary Examiner* — Jessica H Lutz
(74) *Attorney, Agent, or Firm* — Thomas W. Galvani, P.C.; Thomas W. Galvani

(57) ABSTRACT

A corner wear plate assembly includes a base having first and second base plates formed to each other along a corner, and a wear plate having first and second wear bodies formed to each other along a corner. The second base plate includes a slot with an enlarged aperture. The wear plate includes a hold. The assembly includes a nut to receive a key. The nut is applicable through the aperture into the slot, and then is moveable into a position offset from the aperture where the nut is captured under the second base plate. In an applied condition of the wear plate on the base, and in the offset position of the nut, the bore is registered with the slot and the hold to define a keyway, and the key is applicable to the keyway for engagement with the nut to lock the wear plate on the base.

20 Claims, 5 Drawing Sheets

(56) References Cited

U.S. PATENT DOCUMENTS

| | | | | |
|---|---|---|---|---|
| 5,937,549 | A | 8/1999 | Bender et al. | |
| 5,963,695 | A | 10/1999 | Joyce | |
| 6,030,143 | A | 2/2000 | Kreitzberg | |
| 6,041,529 | A | 3/2000 | Ruvang | |
| 6,194,080 | B1 | 2/2001 | Stickling | |
| 7,144,183 | B2 * | 12/2006 | Lian | E02F 9/2841 403/319 |
| 7,367,144 | B2 | 5/2008 | Jones et al. | |
| 7,712,234 | B2 | 5/2010 | Striegel | |
| 7,770,310 | B2 * | 8/2010 | Keech | E02F 3/8152 37/455 |
| 8,336,233 | B1 * | 12/2012 | Lombardo | F16B 3/00 37/453 |
| 9,371,631 | B2 | 6/2016 | Karlsson et al. | |
| 10,428,494 | B1 * | 10/2019 | Lombardo | E02F 9/2883 |
| 2007/0044349 | A1 | 3/2007 | McClanahan et al. | |
| 2014/0173949 | A1 * | 6/2014 | Karlsson | E02F 9/2833 37/455 |
| 2016/0130790 | A1 * | 5/2016 | Serrurier | E02F 9/2883 37/450 |
| 2016/0130791 | A1 * | 5/2016 | Serrurier | E02F 9/2883 37/450 |
| 2019/0040609 | A1 * | 2/2019 | Wilson | B23K 31/025 |

* cited by examiner

CORNER WEAR PLATE ASSEMBLY

CROSS-REFERENCE TO RELATED APPLICATIONS

This application claims the benefit of U.S. Provisional Application No. 62/987,291, filed Mar. 9, 2020, which is hereby incorporated by reference.

FIELD

The present specification relates generally to heavy machinery equipment, and more particularly to protective equipment for heavy machinery equipment.

BACKGROUND

Heavy machinery equipment are used in excavation, demolition, construction, and similar activities. The parts of heavy machines used for digging are exposed to a great amount of wear in operation. For instance, the bucket of an excavator can be used to dig, rip, crush, cut, or lift dirt, rock, concrete, metal, or other rugged materials, all of which constantly wear against and abrade the surface of the excavator's bucket.

Heavy machinery parts are expensive and time-consuming to maintain. To replace a worn bucket on an excavator, for example, a new bucket must be ordered and shipped, the excavator must be taken out of operation, the old bucket must be removed, and the new one must be installed. This requires significant time and effort, and workers are often injured during the replacement process, which usually involves sledgehammers and blowtorches.

Various attempts have been made to protect heavy machinery parts to avoid having to replace an entire part. For instance, on the buckets mentioned above, various guards and shrouds are frequently bolted onto the lower edge of the bucket. Sometimes the bolts binding these shrouds to the edge become damaged or cemented, and the shrouds become very difficult to remove. Further, a number of manufacturers make shrouds to fit buckets, but the shrouds are not identical; each is of just slightly a different dimension. However, all rely on the same fixtures to secure to the bucket. This often results in slight play of the shroud on the bucket, which results in premature wear. An improved system for protecting heavy machinery equipment is needed.

SUMMARY

A corner wear plate assembly includes a base having first and second base plates formed to each other along a corner, and a wear plate having first and second wear bodies formed to each other along a corner. The second base plate includes a slot with an enlarged aperture. The wear plate includes a hold. The assembly includes a nut to receive a key. The nut is applicable through the aperture into the slot, and then is moveable into a position offset from the aperture where the nut is captured under the second base plate. In an applied condition of the wear plate on the base, and in the offset position of the nut, the bore is registered with the slot and the hold to define a keyway, and the key is applicable to the keyway for engagement with the nut to lock the wear plate on the base.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1A:
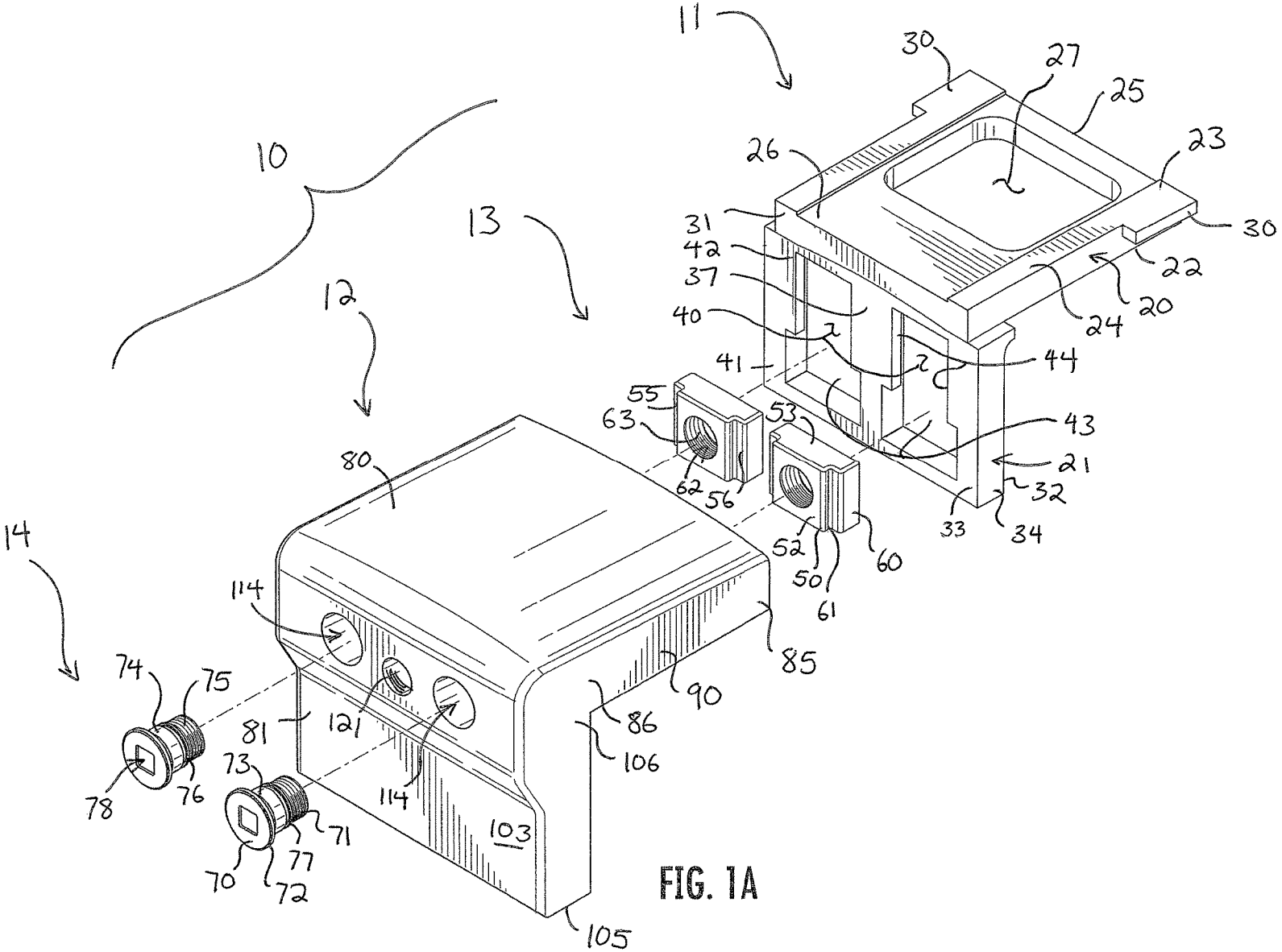
FIG. 1A is a top front perspective view of a corner wear plate assembly.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

Figure 1B:
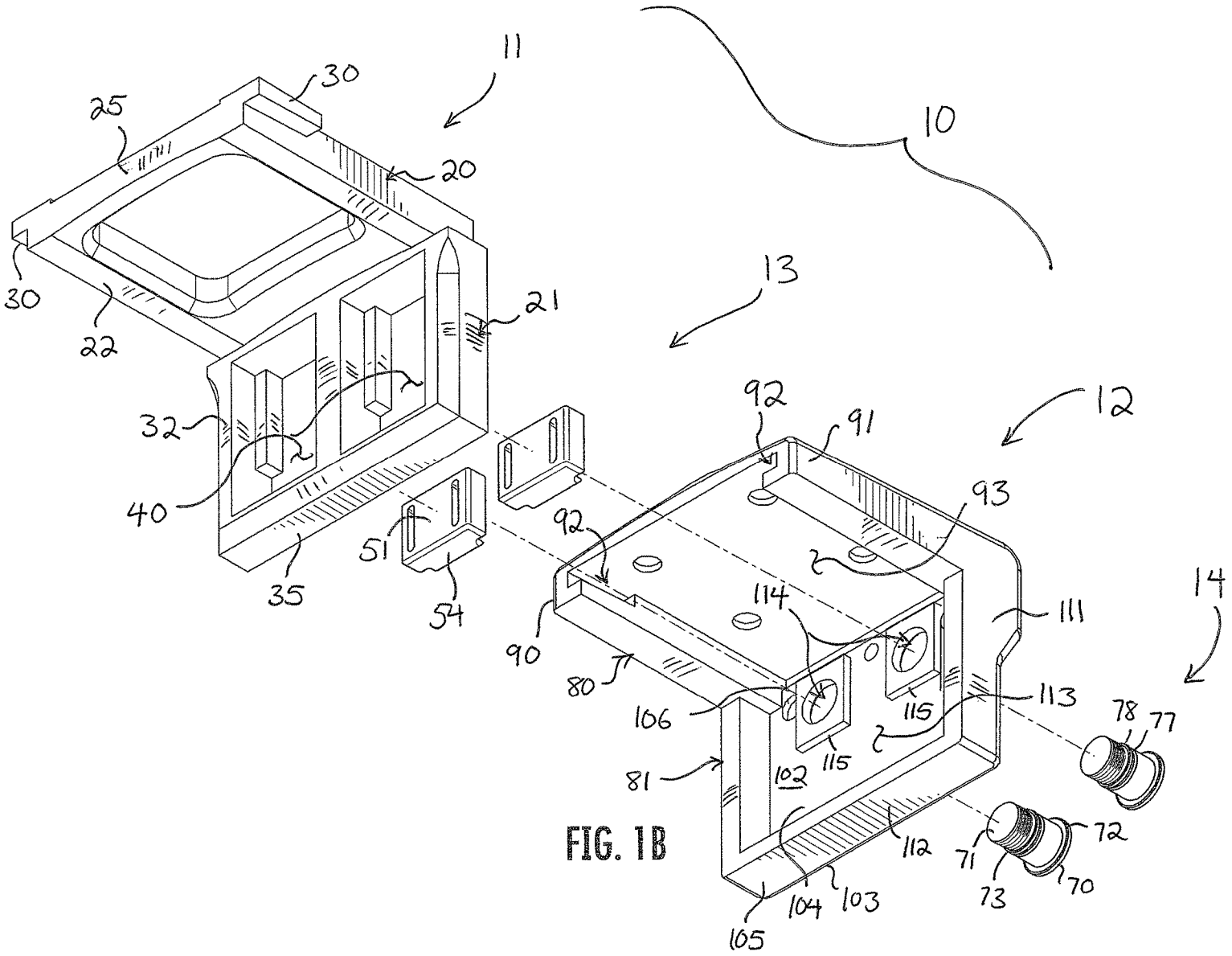
FIG. 1B is a bottom rear perspective view of the corner wear plate assembly.

FIGS. 1A and 1B show front top and rear bottom exploded perspective views of a corner wear plate assembly 10 ("assembly 10"). The assembly 10 includes a base 11, a wear plate 12 for covering the base 11, nuts 13 applicable to the base 11, and keys 14 which can be passed through the wear plate 12 to engage with the nuts 13 when they are applied to the base 11, so as to secure the wear plate 12 on the base 11.

The base 11 is a corner bracket having a horizontal first or upper base plate 20 and a vertical second or lower base plate 21. The upper base plate 20 has a bottom 22, a top 23, and a solid body 24 extending between the bottom 22 and the top 23. The upper base plate 20 has a free end 25 distal to or opposite the lower base plate 21, and an opposed joined or corner end 26 proximate the lower base plate 21. A large roughly rectangular hole 27 is formed through the otherwise solid body 24 of the upper base plate 20, proximate the free end 25, but thereby defining a thin transverse member or portion of the body 24 at the free end 25 and a larger transverse member or portion of the body 24 at the corner end 26.

At the free end 25 of the upper base plate 20, opposite the lower base plate 21, and beginning roughly two-thirds to three-fourths of the distance from the corner end 26 to the free end 25, two horizontal flanges 30 projects outwardly from the body 24, at the top 23. These flanges 30 overhang the sides and help guide and retain the wear plate 12 on the base 11. As best seen briefly in FIG. 1B, the flanges 30 expand slightly in height toward the free end 25.

The upper base plate 20 is integrally formed to the lower base plate 21 at a common corner 31 of the base 11. The lower base plate 21 is oriented at preferably ninety degrees to the upper base plate 20, such that the base 11 turns ninety degrees to overlap and cover a corner of the bucket or other heavy equipment part to be protected.

The lower base plate 21 has a bottom 32, top 33, and body 34 therebetween, and they are continuous to those mentioned above, but they are oriented transversely with respect thereto. In other words, the bottoms 22 and 32 of the upper and lower base plates 20 and 21 are both against the bucket when applied thereon, and the tops 23 and 33 are both directed away from the bucket. The base 11 has a free end 35 distal to and below the corner 31 and an opposed joined or corner end 36 at the corner 31. Indeed, the two corner ends 26 and 36 cooperate to form the corner 31. Two slots are formed entirely through the body 34, in a vertical direction, parallel to each other, and spaced apart, so as to define a vertical rib 37 therebetween extending from the free end 35 to the corner end 36. The rib 37 is integrally and monolithically formed to the body 34 as a single piece, and it extends centrally in the base 11.

The rib 37 defines two slots 40 in the lower base plate 21, each of which is identical and only one of which will be described without differentiation. The slot 40 has opposed ends 41 and 42; end 41 is a lower and end 42 is an upper end. An aperture 43 is located in the slot 40 at the lower end 41 thereof. The aperture 43 is a widened or enlarged section of the slot 40. While the slot 40 has two discrete widths between its ends 41 and 42; above the aperture 43, the slot 40 has a smaller width, and at the aperture 43, the slot 40 has a larger width. Thus, the aperture 43 is an enlarged portion of the slot 40.

The aperture 43 is defined by opposed rectangular notches formed into the body 34, respectively. Proximate to the corner end 36 of the lower base plate 21, two lips 44 project laterally inward into the slot, at the top 33 of the lower base plate 21. One lip 44 projects from the inner surface of the rib 37; the other projects from the inner surface of the body 34 along the outside of the lower base plate 21. The lips 44 run along these inner surfaces from the corner end 36 to just past halfway to the free end 35. The lips 44 both extend approximately halfway down from the top 33 toward the bottom 32. Because the lips 44 do not extend entirely to the bottom 32, the lips 44 form a two-tiered inner surface of each slot 40; an upper first tier projects further into the slot 40 than does a lower second tier. However, the apertures 43 are formed through the lips 44, so that they are eliminated in the enlarged sections of the slots 40. In other words, because the lips 44 run only just beyond halfway from the corner end 36 to the free end 35, where the aperture 43 is located, the inner surfaces are flat and single-tiered.

Preferably, the base 11 is welded to the work surface of the bucket continuously along the bottoms 22 and 32 of both the lower and upper base plates 20 and 21. After the base 11 is fixed to the work surface 15, in preparation for operation, the nuts 13 are applied to the base 11. Briefly, the nuts 13 are sized and shaped to be fit through the aperture 43 and then under the overhanging lips of the slot 40 to capture and retain the nuts 13 therein.

The nuts 13 are identical in every way, and only one will be described herein, with the understanding that the description applies equally to both nuts 13. Referring primarily to FIGS. 1A and 1B, the nut 13 has a solid body 50 with a bottom 51, an opposed top 52, and opposed ends 53 and 54. The ends 53 and 54 are flat and vertical, extending normally with respect to the bottom 51 and top 52, which are parallel to each other. The nut 13 also has opposed stepped sides 55 and 56.

Proximate the bottom of the nut 13, the side 56 projects outwardly to a lower face 60, which extends further than does an upper face 61 proximate the top 52 of the nut 13. The lower and upper faces 60 and 61 are coextensive and parallel to each other, but are laterally offset from a center of the nut 13. Similarly, proximate the bottom of the nut 13, the opposite side 55 projects outwardly to its own lower face 60, which extends further than does its upper face 61 proximate the top 52 of the nut 13. The lower and upper faces 60 and 61 on this side 55 are coextensive and parallel to each other, but are laterally offset from a center of the nut 13. On both sides 55 and 56, the lower faces 61 are offset from the center of the nut 13 by the same distance, and the upper faces 60 are offset from the center of the nut 13 by the same distance. In this way, the nut 13 has a tiered cross-section, which corresponds to the tiered inner surface of the slot 40 in the base 11.

Formed into the nut 13 and extending from the top 52 toward the bottom 51, is a bore 62. The bore 62 is cylindrical, preferably blind, and formed with threads 63 to receive and threadably engage with the key 14. The threads 63 begin slightly below the top of the nut 13 and wind helically around the bore 62 to the bottom thereof.

A key 14 is applied to the nut 13. The two keys 14 are identical and only one is described here, with the understanding that the description applies equally to both. The key 14 has a top 70 and an opposed bottom 71. The key 14 has an enlarged head 72 at its top 70, and a shank 73 extends from the bottom of the head 72 to the bottom 71 of the key 14. The top of the head 72 is flat and wide, and chamfers inwardly from the top to a reduced diameter where the head 72 transitions integrally and monolithically to the shank 73. The shank 73 has a smooth upper portion 74 and a threaded lower portion 75, which threadably engages with the threads 63 in the nut 17, as will be explained. Between the upper and lower portions 74 and 75 is an annular channel 76 holding an elastomeric gasket 77 to limit the migration of dirt, dust, and other debris between the nut 13 and the key 14.

A square socket 78 is formed into the top of the key 14. The socket 78 accepts a square-headed wrench so that the key 14 can be rotated in a first direction to engage the key 14 with the nut 13 and in a second direction to disengage the key 14 from the nut 13.

Still referring to FIGS. 1A and 1B, the wear plate 12 covers the base 11 to protect the base 11, and the work surface of the bucket below it, from wear. The wear plate 12 is meant to be worn away as the bucket digs, rips, crushes, cuts, or lifts dirt, rock, concrete, metal, or other rugged materials from a work site. The wear plate 12 is constructed from a wearable material or combination of materials having characteristics of ruggedness, durability, rigidity, and hardness, such as iron or steel, and is preferably integrally and monolithically formed or cast.

The wear plate 12 includes a horizontal first or upper wear body 80 and a vertical second or lower wear body 81, formed integrally to each other at a corner. The upper wear body 80 is very thick; it has an underside or bottom 82, a top 83, and a solid body 84 extending therebetween. The upper wear body 80 has a distal or free end 85 distal to or opposite the corner and the lower wear body 81, and it has an opposed proximal, or joined, or corner end 86 proximate the lower wear body 81. The body 84 is entirely solid, and its outer surface is preferably smooth and free of holes, edges, and other discontinuities. As the heavy machinery operates, the wear body 53 is abraded, worn, and consumed, such that that outer surface advances further toward its bottom 82.

The upper wear body 80 has two opposed sidewalls 90 flanking the upper wear body 80. The sidewalls 90 and 91 act as aprons depending from the upper wear body 80, to cover and protected the opposed sides of the upper base plate 20. The sidewalls 90 and 91 extend entirely from the corner end 86 to the free end 85. At the free end 85, however, a long notch 92 is formed into each sidewall 90 and 91, just below the bottom 82 of the upper wear body 80. The notches 92 are only visible in FIG. 1B. Each notch 92 extends approximately halfway into the respective sidewall 90 and 91 from the inner surface thereof, and extends from the free end 85 to approximately one-fourth to one-third of the distance to the corner end 86. The notches 92 are constant in height and width, and are configured to tightly receive the flanges 30 on the top 23 of the upper base plate 20.

Indeed, the bottom 82 of the upper wear body 80 cooperates with the inner surfaces of the sidewalls 90 and 91 to define a relatively thin interior cavity 93 for receiving the upper base plate 20. When the upper base plate 20 is received in this interior cavity 93, the flanges 30 press fit into the notches 92.

Like the upper wear body 80, the lower wear body 81 is very thick; it has an inner face 102, an opposed outer face 103, and a solid body 104 extending therebetween. The lower wear body 81 has a distal or free end 105 distal to or opposite the corner and the upper wear body 80, and it has an opposed proximal, or joined, or corner end 106 proximate the upper wear body 80. The body 104 is entirely solid but for two holds, as explained below. The outer surface is preferably smooth and free of holes, edges, and other discontinuities. As the heavy machinery operates, the wear body 53 is abraded, worn, and consumed, such that the outer face 103 advances further toward its inner face 102. The lower wear body has a thickness between the inner and outer faces 102 and 103 which is considerable. That thickness is greater at and proximate to the corner end 86 than it is at or proximate to the free end 85, allowing the wear plate 12 greater wear near the corner.

The lower wear body 81 has two opposed sidewalls 110 and 111 flanking the lower wear body 81. The sidewalls 110 extend entirely from the corner end 106 to the free end 105, and then a third sidewall 112, projecting inwardly from that free end 105, joins the sidewalls 110 and 111. The sidewalls 110, 111, and 112 act as aprons projecting inwardly from the lower wear body 81, to cover and protect the sides of the lower base plate 21. The inner face 102 of the lower wear body 81 cooperates with the inner surfaces of the sidewalls 110, 111, and 112 to define an interior cavity 113 for receiving the lower base plate 21.

Figure 4A:
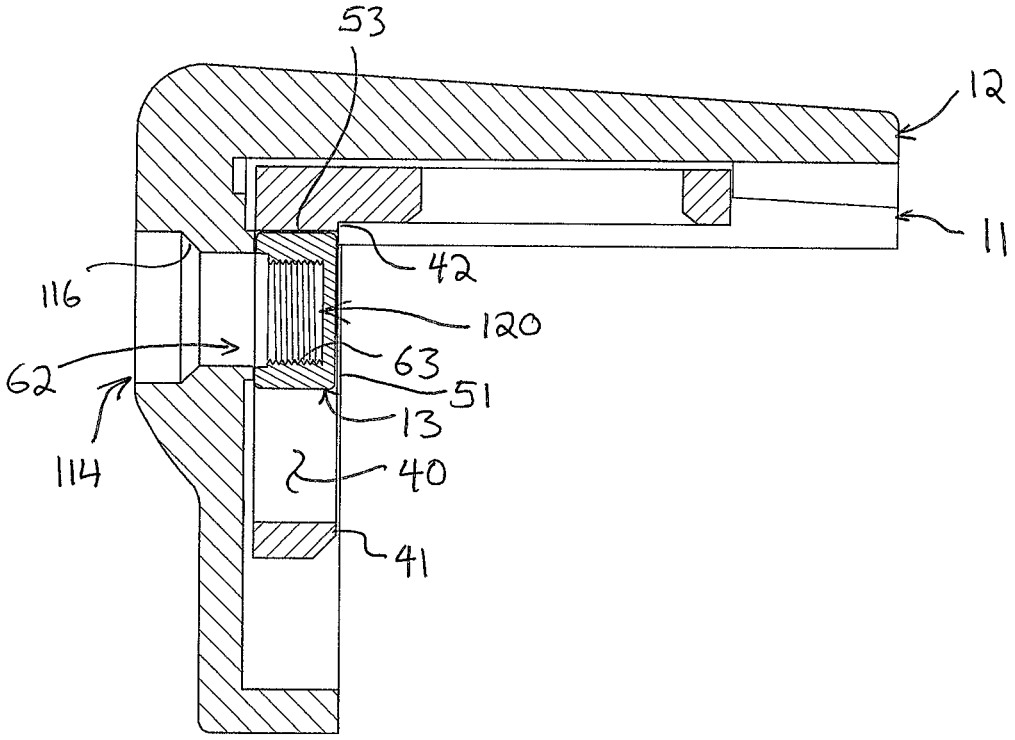
FIGS. 4A and 4B are section views, taken along the line 4-4 of FIG. 3A, showing a key being installed in one of the nuts in the base.
Figure 4B:
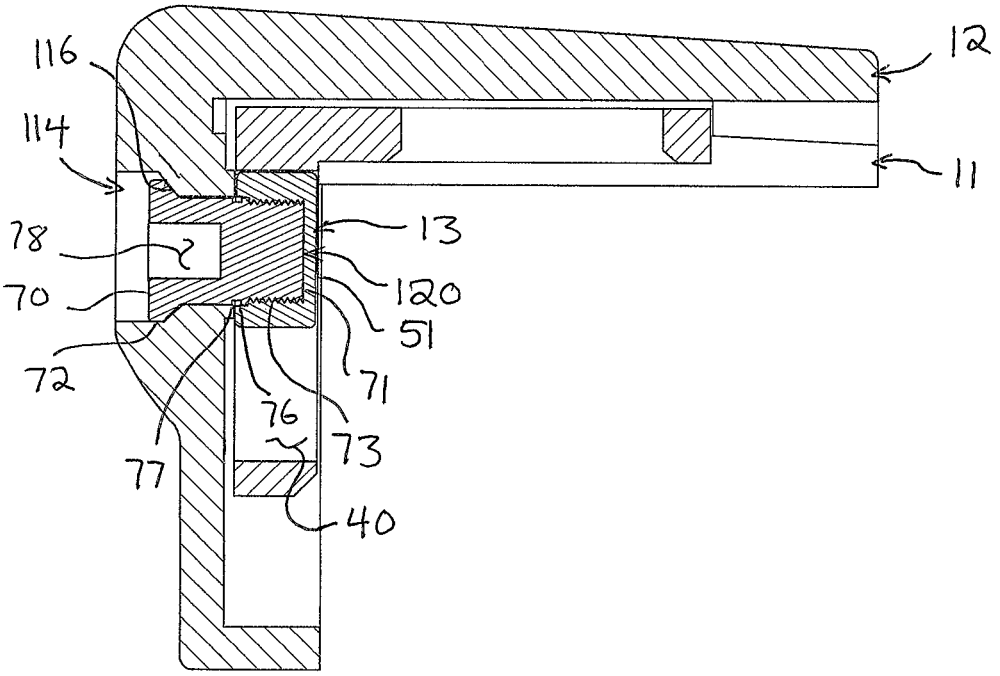

Referring primarily to FIGS. 1B and 4A, two holds 114 are formed in the wear plate 12, in the lower wear body 81. The holds 114 are identical in every respect but for location, and as such, the description herein will refer only to a single hold 114. The hold 114 is a recess extending into the lower wear body 81 from the outer face 103 of the lower wear body 81. The hold 114 has a tiered cylindrical shape; proximate the outer face 103, the hold 114 extends inward with a first diameter which then constricts or tapers to a second reduced diameter. The constriction defines a seat 116 in the hold 114. The hold continues from the seat 116 at the second reduced diameter entirely through to the inner face 102. Surrounding the hold 114 on the inner face 102, however, are slight inward projections 115 into the interior cavity 113. The projections 115 are separate, raised rectangular projections encircling the holds 114.

Figure 2A:
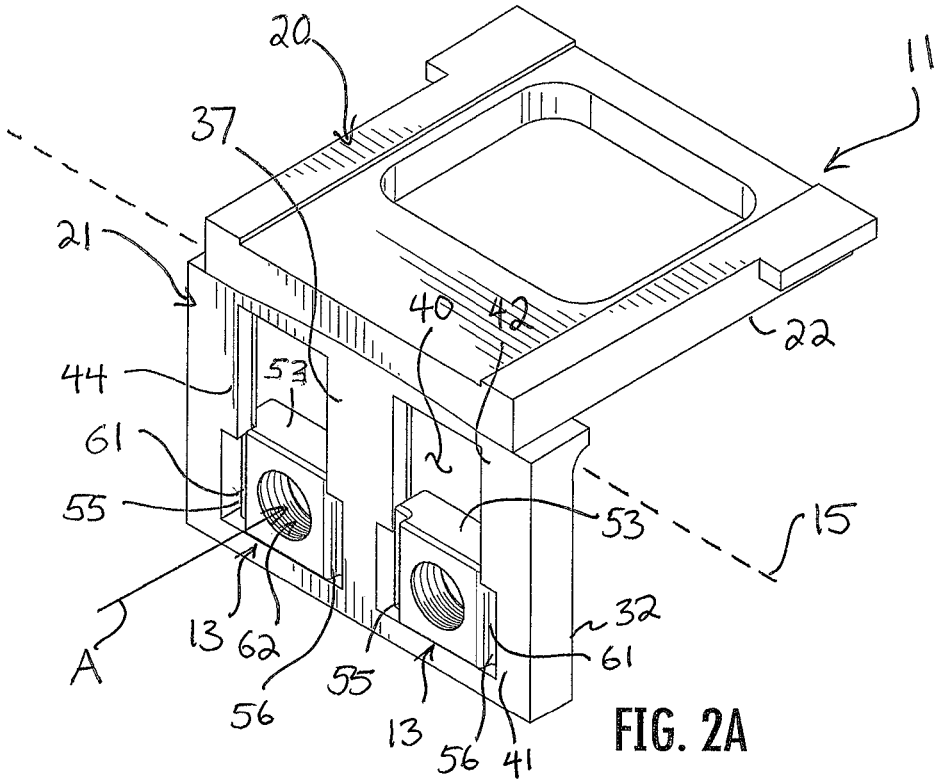
FIGS. 2A and 2B are top front perspective views of a base of the corner wear plate assembly, with two nuts moving from first positions to second positions, respectively.

Turning now to FIGS. 2A-4B, in operation, the assembly 10 is secured on a work surface 15 to protect it from wear and damage. The work surface 15 is shown as broken line in FIG. 2A, representing the corner of a heavy machinery equipment shovel or bucket, or similar apparatus. Initially, the work surface 15 is prepared by cleaning. Dust and dirt are removed and the work surface 15 is washed or made clean. The base 11 is then fixed to the work surface such as by welding. Preferably, a continuous weld is formed along outside of the bottoms 22 and 32 of the base 11, thereby binding the base 11 to the work surface 15. Formation of a continuous weld prevents the ingress of dirt, dust, and debris into the interior cavities 93 and 113 of the base 11 when the assembly 10 is in use.

Once the base 11 is so secured, the nuts 13 are applied thereto. The first nut 13 is taken up, such as by hand, and the bottom 51 of the nut 13 is directed downward toward the base 11 in the lower base plate 21. The rectangular nut 13 is registered with the rectangular aperture 43 and is then applied through the aperture 43 by moving it along the direction indicated by arrowed line A in FIG. 2A, still with the bottom of the nut 13 directed toward the base 11. The nut 13 is fully applied through the aperture 43, so that the nut 13 is in a first position in which the nut 13 is disposed and registered in the aperture 43 and the bottom of the nut 13 is against the work surface 15 (as shown in FIG. 2A). In this first position of the nut 13, the respective side 55 and 56 of the nut 13 (depending on whether the nut 13 is applied the slot 40 on the left or right) is in snug contact with the rib 37, and the end 54 of the nut 13 is against the lower end 41 of the slot 40.

The lower faces 60 of the nut 13 are each in sliding contact with the inner surfaces of the slot 40, but, because the nut 13 is disposed in the aperture 43, which is defined by the notches formed into the body 34, there are no overhanging lips 44, and so the upper faces 61 are not in contact with the inner surfaces of the slot 40. The opposed sides 55 and 56 at the widened bottom 51 of the nut 13 contact the inner surfaces of the slot 40 snugly and prevent rotation of the nut 13 with respect to the base 11. Further, because the nut 13 is snugly received in the slot 40, lateral play of the nut 13 in the aperture 43 between the rib 37 and the body 34 is minimized. As such, the only direction in which the nut 13 can move—other than out through the aperture 43—is in a translational direction between the opposed ends of the base 11. In other words, the nut 13 can only be slid up in the lower base plate 21.

Figure 2B:
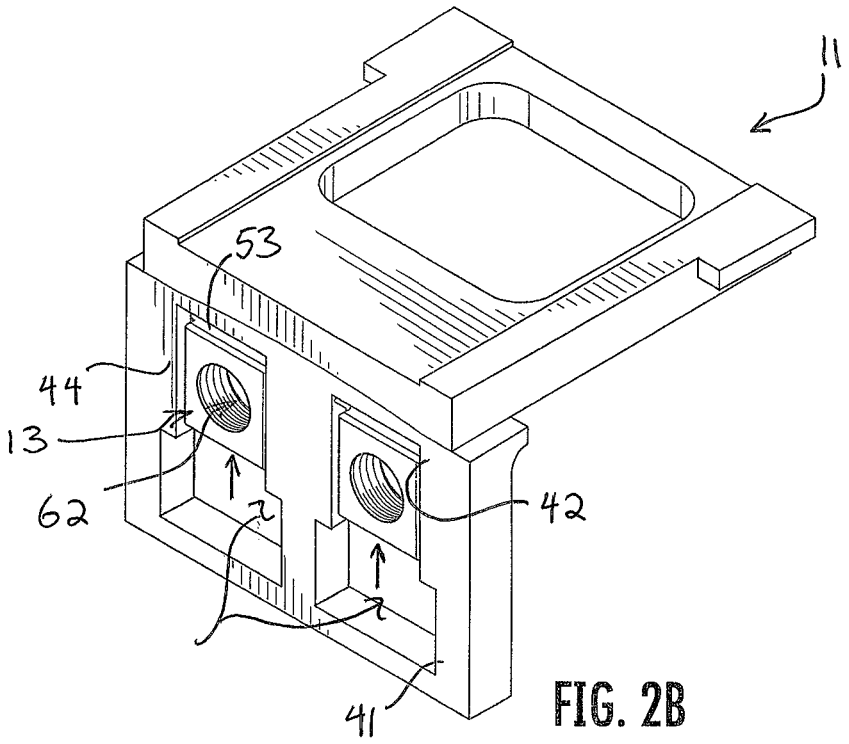

Indeed, the nut 13 is translated through the slot 40 to a second position, with the end 53 of the nut 13 against the upper end 42 of the slot 40, as shown in FIG. 2B. The lower faces 60 are each in sliding contact with the inner surfaces of the slot 40, and once the nut 13 moves just away from the aperture 43, the upper faces 61 are also in sliding contact with the inner surfaces, along the overhanging lips 44. Indeed, as soon as the nut 13 is slightly translated and offset from the aperture 43, the widened bottom 51 of the nut 13 is in abutting contact with each of the overhanging lips 44; the interaction between the bottom 32 and the overhanging lips prevents the nut 13 from lifting vertically out of the slot 40. And so the nut 13 can only be translated between the first and second positions. In the second position of the nut 13, the nut 13 has been translated fully toward the corner end 36 of the lower base plate 21.

In the second position of the nut 13, the nut 13 is offset from the aperture 43 and is captured by the base 11. The end 53 of the nut 13 is in abutting contact with the upper end 42 of the slot 40 proximate the end of the base 11. The lower faces 60 remain in sliding contact with the inner surfaces of the slot 40, and the upper faces 61 remain in sliding contact with the inner surface along the overhanging lips 44. The widened bottom 51 of the nut 13 remains in abutting contact with each of the overhanging lips 44, thereby preventing the nut 13 from lifting vertically out of the slot 40. This same process is used for applying the other nut 13 in the other slot 40.

Figure 3A:
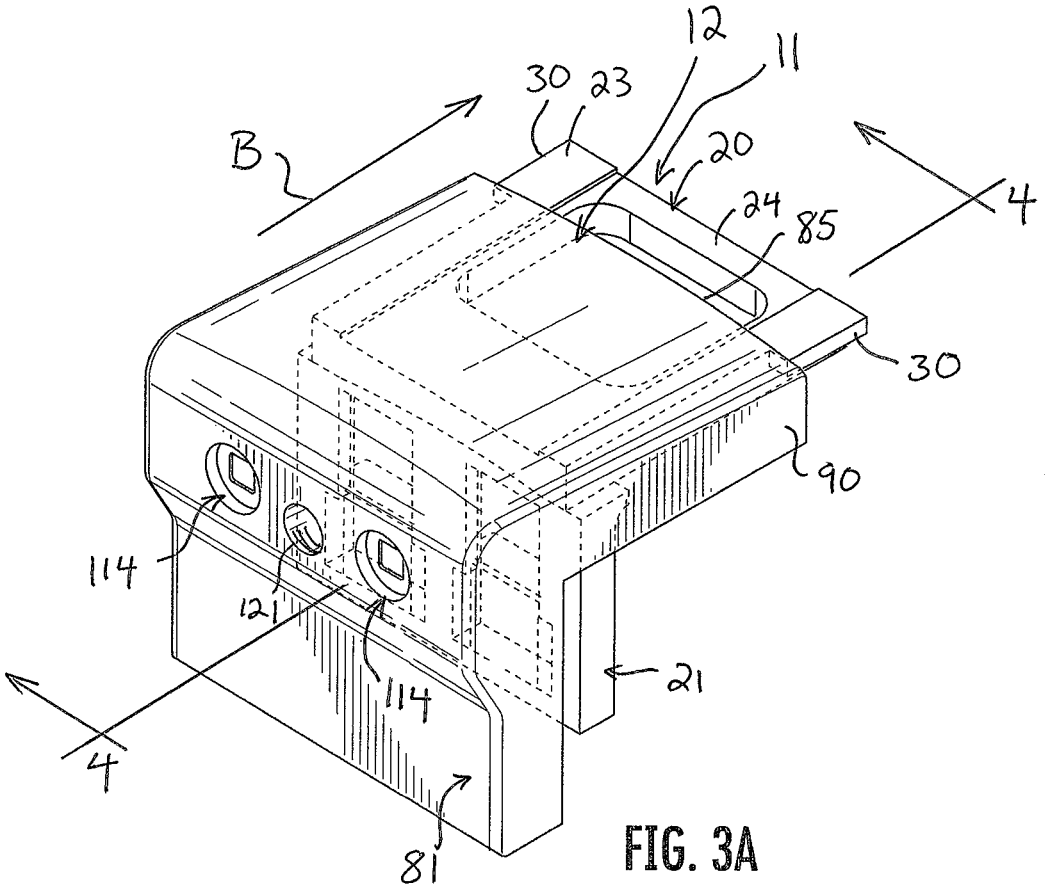
FIGS. 3A and 3B are top front perspective views of a wear plate of the corner wear plate assembly, showing the wear plate being applied to the base.
Figure 3B:
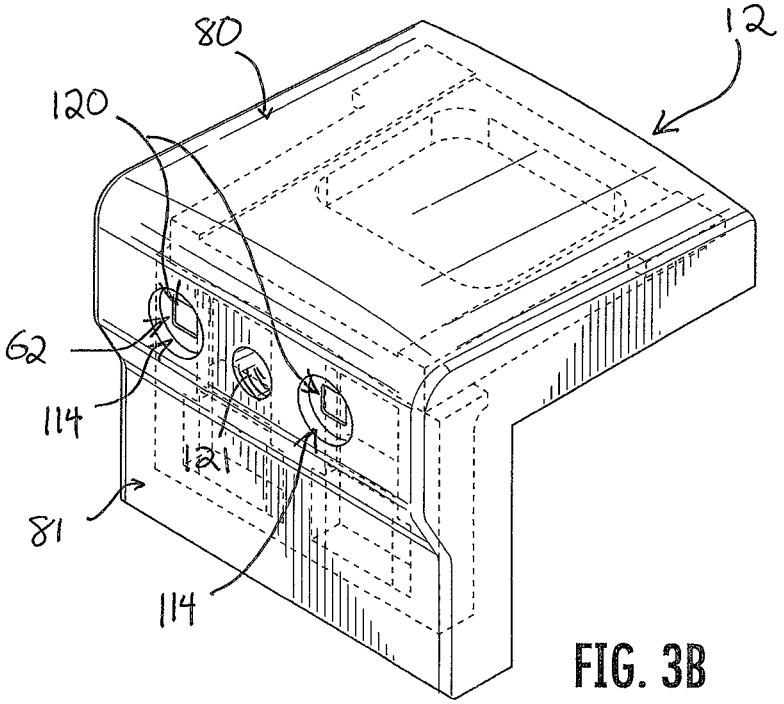

With the nuts 13 so captured, the wear plate 12 can then be applied over the base 11. The wear plate 12, with its solid upper wear body 80, is quite heavy and in some embodiments is picked up by a handle formed directly on the outer surface of the wear plate 12. In some embodiments, such as the one shown in these drawings, the wear plate 12 has a threaded bore 121 on the lower base plate 21 which can be applied with an eyebolt, threaded handle, or the like. With reference now to FIGS. 3A and 3B, the wear plate 12 is moved over the side of the base 11, with the interior cavities 93 and 113 directed toward the base 11. The wear plate 12 is held in this free condition, separated from the base 11 but still registered with the base 11 so that the holds 114 are registered with the nuts 13 in their second positions applied in the slots 40.

With the wear plate 12 so registered, it is lowered onto the base 11. The interior cavity 93 receives a forward portion of the upper base plate 20; roughly, the free end 85 of the upper wear body 80 is placed over an intermediate portion of the upper base plate 20, leaving the flanges 30 exposed. The sides of the body 24 of the upper base plate 20 are fit between, in a flanked fashion, the sidewalls 90 and 91 of the wear plate 12, and the top 23 of the upper base plate 20 is received against the bottom 82 of the wear plate 12. In other words, the top of the wear plate 12 rests directly on the top of the base 11. The lower wear body 81, however, is separated from the lower base plate 21, offset by a gap.

The wear plate 12 is then slidably translated over the base 11 in the direction indicated by arrowed line B, as in FIG. 3A, and then moved to an applied condition as in FIG. 3B.

Translating the wear plate 12 and sliding it is helpful because the wear plate 12; strong technicians may be able to simply hold the wear plate 12 just above the base 11 and translate the wear plate 12 onto the base 11, but generally, it is easier to slidably translate the wear plate 12. During translation, the flanges 30 of the base 11 enter the notches 92 of the wear plate 12. Because the flanges 30 expand slightly from their front toward the free end 25 of the upper base plate 20, they are increasingly pressed into the notches 92 as the wear plate 12 moves further into an applied condition on the base 11. When the wear plate 12 is fully moved into the applied condition, the upper wear body 80 is registered with the upper base plate 20, and the lower wear body 81 is registered with the lower base plate 21. The free end 85 of the wear plate 12 is flush with the free end 35 of the base 11, and the flanges 30 are tightly press fit into the notches 92. This firmly holds the wear plate 12 on the base 11, preventing relative vertical and horizontal movement. Further, the sidewalls 111, 112, and 113 of the lower wear body 81 closely receive the body 34 of the lower base plate 21, so that the wear plate 12 is prevented from moving laterally on the base 11.

When the wear plate 12 is seated, the bottom 82 of the upper wear body 80 is above the work surface 15 with a small gap therebetween. Indeed, both the upper wear body 80 and the lower wear body 81 are just slightly separated from the work surface 15 by a small gap.

Once the wear plate 12 has been properly applied over the base 11 with the nuts 13 captured therein, the keys 14 can be applied. Referring now to FIGS. 3A-4B, when the nuts 13 are in the second positions, the nuts 13 are below the underside of the wear plate 12, and the bores 62 of the nuts 13 are registered with the slot 40 and with the holds 114 of the wear plate 12. The holds 114 are directly above the bores 62. In this applied condition of the wear plate 12 and the second position of the nut 13, the bore 62, the slot 40, and the hold 114 define a keyway 120 to receive the key 14. The keys 14 are applicable to the keyways 120. The keys 14 are held above the holds 114, with the shanks 73 directed downward toward the holds 114. Each key 14 is moved downward and passed into a respective one of the holds 114.

Referring to just one of keys 14, because the description applies equally to both, the key 14 is in a non-engaged condition initially. In the non-engaged condition of the key 14, the key 14 is applied to the hold but the threads 63 of the key 14 are not yet threadably engaged with the threads of the nut 13; the bottom 71 of the key 14 is still above the threads 63. To threadably engage the key 14 with the nut 13, the key 14 is rotated in the first direction with respect to the nut 13. The key 14 is rotated with respect to the nut 13 until it is fully seated.

When fully seated, the head 72 of the key 14 is in direct and continuous contact with the seat 116 of the hold 114. The head 72 is closely received laterally between the sides of the hold 114. The shank 73 extends through the bore 62, and the bottom 71 of the key 14 is in direct and continuous contact against the bottom of the nut 13. When the key 14 is fully threadably engaged in this manner, the nut 13 and the key 14 are prevented from separating from each other and also from translating with respect to the base 11 or the wear plate 12. With the nut 13 and key 14 secured to each other, and with the head 72 of the key 14 bearing against the seat 116 of the wear plate 12 and the widened bottom 51 of the nut 13 bearing against the lips of the base 11, the wear plate 12 is secured on the base 11, prevented from moving from the applied condition to the free condition. And, of course, since the base 11 is fixed to the work surface, the wear plate 12 is secured to the work surface to cover and protect it. Moreover, the gasket 77 disposed in the channel 76 of the key 14 is compressed within the hold 114 and thus prevents migration of dirt, dust, and other debris into the nut-key-keyway interface.

With the assembly 10 so protecting the work surface 15, the heavy machinery can be operated without risk of damage to the work surface under the assembly 10. Eventually, the wear plate 12 is worn away so that the wear surface thereof is close to the top 70 of the key 14. Routine inspection will find that the assembly 10 has been worn sufficiently to justify maintenance.

Full replacement of the assembly 10 is not necessary. Rather, when the assembly 10 requires maintenance, a worker takes a square-headed wrench and inserts it into the socket 78 of the key 14. The worker then rotates the wrench and the key in the second direction. Rotation in the second direction threadably disengages the key 14 from the nut 13, backing the key 14 out of the nut 13 in an upward direction. When the threads of the key 14 fully disengage from the nut 13, the key 14 can be removed and discarded, as can the worn wear plate 12. The base 11 is left still secured to the work surface 15, and the nuts 13 are still in the slot 40. If the nuts 13 need to be replaced, they can be removed by translating them from their second positions to the first position in the aperture 43 and then withdrawing them from the base 11 through the aperture 43. New nuts 13 can be introduced to the base 11 as described above, a new wear plate 12 can be applied over the base 11 as described above, and new keys 14 can then be applied and engaged, as described above. In this way, the assembly 10 can be continually repaired and re-used.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A corner wear plate assembly comprising:

a base having first and second base plates formed integrally to each other along a corner of the base, wherein the first base plate includes opposed flanges projecting outwardly from a top of the first base plate opposite the second base plate, and the second base plate includes a slot formed with an enlarged aperture;

a wear plate having first and second wear bodies formed integrally to each other along a corner of the wear plate, wherein the wear plate includes a hold recessed below the second wear body, the first wear body includes sidewalls depending from opposed sides of the first wear body which is formed with longitudinal notches, and the wear plate moves between a free condition off the base and an applied condition covering the base by moving the flanges into and out of the longitudinal notches;

a nut and a key, the nut formed with a blind bore to receive the key;

the key includes an annular channel for carrying a gasket to prevent migration of debris into the bore; and the nut is applicable through the aperture into the slot, and then is moveable between a first position registered with the aperture and a second position offset from the aperture where the nut is captured under the second base plate;

wherein in the applied condition of the wear plate and the second position of the nut, the bore is registered with the slot and the hold to define a keyway, and the key is applicable to the keyway for engagement with the nut to lock the wear plate on the base.

2. The wear plate assembly of claim 1, wherein in the applied condition of the wear plate:

the first wear body is registered over the first base plate; and the second wear body is registered over the second base plate.

3. The wear plate assembly of claim 1, wherein the second wear body includes a proximal end proximate the first wear body and a distal end distal to the first wear body, and the hold is formed proximate the proximal end.

4. The wear plate assembly of claim 3, wherein the second wear body has a thickness which is greater at the proximal end than at the distal end.

5. The wear plate assembly of claim 1, wherein the nut is formed with threads, and the key is formed with threads complemental to the threads on the nut.

6. The wear plate assembly of claim 1, wherein the slot has an overhanging lip which captures the nut when the nut is in the second position thereof.

7. The wear plate assembly of claim 6, wherein the nut has a widened bottom which is in abutting contact with the overhanging lip when the nut is in the second position thereof.

8. The wear plate assembly of claim 1, wherein, when the key is applied to the nut, the wear plate is in the applied condition, and the nut is in the second position:

the key and the nut are prevented from separating from each other and from translating with respect to the base; and the wear plate is prevented from movement from the applied condition to the free condition.

9. A wear plate assembly comprising:

a base having first and second base plates, wherein the first base plate has two opposed flanges projecting outwardly from the first plate, and the second base plate has a slot formed with an enlarged aperture;

a wear plate having first and second wear bodies, wherein the first wear body includes sidewalls depending from opposed sides of the first wear body which are formed with opposed longitudinal grooves configured to slideably receive the opposed flanges of the first base plate, the second wear body includes a hold recessed below the second wear body, and the wear plate moves between a free condition off the base and an applied condition covering the base;

a nut and a key, the nut formed with a blind bore to receive the key;

the key includes an annular channel for carrying a gasket to prevent migration of debris into the bore; and the nut is applicable through the aperture into the slot, and then is moveable between a first position registered with the aperture and a second position offset from the aperture where the nut is captured under the second base plate;

wherein in the applied condition of the wear plate and the second position of the nut, the bore is registered with the slot and the hold to define a keyway, and the key is applicable to the keyway for engagement with the nut to lock the wear plate on the base.

10. The wear plate assembly of claim 9, wherein in the applied condition of the wear plate:

the opposed flanges of the first base plate are received in the opposed notches of the first wear body;

the first wear body is registered over the first base plate; and the second wear body is registered over the second base plate.

11. The wear plate assembly of claim 9, wherein the second wear body includes a proximal end proximate the first wear body and a distal end distal to the first wear body, and the hold is formed proximate the proximal end.

12. The wear plate assembly of claim 11, wherein the second wear body has a thickness which is greater at the proximal end than at the distal end.

13. The wear plate assembly of claim 9, wherein the nut is formed with threads, and the key is formed with threads complemental to the threads on the nut.

14. The wear plate assembly of claim 9, wherein the slot has an overhanging lip which captures the nut when the nut is in the second position thereof.

15. The wear plate assembly of claim 14, wherein the nut has a widened bottom which is in abutting contact with the overhanging lip when the nut is in the second position thereof.

16. The wear plate assembly of claim 9, wherein, when the key is applied to the nut, the wear plate is in the applied condition, and the nut is in the second position:

the key and the nut are prevented from separating from each other and from translating with respect to the base; and the wear plate is prevented from movement from the applied condition to the free condition.

17. A method of installing a wear plate assembly to a work surface, the method comprising the steps of:

providing a base having first and second base plates formed integrally to each other along a corner of the base, wherein the first base plate includes opposed flanges projecting outwardly from a top of the first base plate opposite the second base plate, and the second base plate includes a slot formed with an enlarged aperture;

fixing the base plate to the work surface, so that the corner of the base overlies a corner of the work surface;

providing a nut having a widened bottom and an opposed blind bore;

applying the nut into the slot of the base;

providing a wear plate having first and second wear bodies formed integrally to each other along a corner of the wear plate, wherein the wear plate includes a hold recessed below the second wear body, the first wear body includes sidewalls depending from opposed sides of the first wear body which are formed with longitudinal notches;

covering the base with the wear plate;

providing a key with an annular channel for carrying a gasket to prevent migration of debris into the bore; and applying the key through the hold of the wear plate and into the bore of the nut, and then engaging the key with the nut to secure the key therein and thereby secure the wear plate on the base.

18. The method of claim 17, wherein:

the step of covering the base with the wear plate further includes translating the wear plate onto the base such that the flanges are slideably received in the notches.

19. The method of claim 17, wherein the step of applying the nut into the slot of the base further comprises passing the nut through the aperture and translating the nut through the slot to a position offset from the aperture.

20. The method of claim 19, wherein the position offset from the aperture is registered below the hold of the wear plate.

* * * * *